US012534241B2

(12) United States Patent
Hosokawa

(10) Patent No.: US 12,534,241 B2
(45) Date of Patent: Jan. 27, 2026

(54) MULTILINE VERTICAL AUTOMATIC FILLING AND PACKAGING MACHINE AND HOPPER

(71) Applicant: SANKO MACHINERY CO., LTD., Kanagawa (JP)

(72) Inventor: Masatoshi Hosokawa, Kanagawa (JP)

(73) Assignee: SANKO MACHINERY CO., LTD., Kanagawa (JP)

( * ) Notice: Subject to any disclaimer, the term of this patent is extended or adjusted under 35 U.S.C. 154(b) by 0 days.

(21) Appl. No.: 19/044,700

(22) Filed: Feb. 4, 2025

(65) Prior Publication Data

US 2025/0282509 A1 Sep. 11, 2025

(30) Foreign Application Priority Data

Mar. 6, 2024 (JP) ..... 2024-033591

(51) Int. Cl.

| | |
|---|---|
| ***B65B 9/20*** | (2012.01) |
| ***B65B 5/10*** | (2006.01) |
| ***B65B 37/02*** | (2006.01) |
| ***B65B 41/12*** | (2006.01) |

(52) U.S. Cl.

CPC ..... *B65B 9/20* (2013.01); *B65B 5/10* (2013.01); *B65B 37/02* (2013.01); *B65B 41/12* (2013.01)

(58) Field of Classification Search

CPC ..... B65B 37/02; B65B 41/12; B65B 5/10; B65B 9/20

See application file for complete search history.

(56) References Cited

U.S. PATENT DOCUMENTS

| | | | | |
|---|---|---|---|---|
| 4,884,599 | A * | 12/1989 | Newman | B65B 1/30 141/10 |
| 5,417,039 | A * | 5/1995 | Hansson | B65B 39/12 53/469 |
| 2004/0261357 | A1* | 12/2004 | Takahashi | B65B 37/08 53/247 |
| 2012/0145516 | A1* | 6/2012 | Tokuda | B65B 9/20 198/533 |
| 2012/0210681 | A1* | 8/2012 | Hennissen | B65B 65/006 53/559 |
| 2013/0232926 | A1* | 9/2013 | Yang | B65B 37/10 53/514 |
| 2016/0114914 | A1* | 4/2016 | Kepinski | B65B 55/24 53/436 |

(Continued)

FOREIGN PATENT DOCUMENTS

JP 4100749 B 6/2008

*Primary Examiner* — Himchan Song
(74) *Attorney, Agent, or Firm* — Rimon P.C.

(57) ABSTRACT

An automatic filling and packaging machine includes a hopper A configured to supply a filling material A and a hopper B configured to supply a filling material B. The hopper A includes: an upwardly open receiving part; and a first branch part and a second branch part, which are bifurcated from a lower portion of the upwardly open receiving part. The first branch part and the second branch part allow supply of the filling material A to two corresponding filling pipes. The second branch part is extended in a direction of arrangement of the filling pipes so that at least one of the filling pipes supplied with the filling material from the hopper B is located between an outlet of the first branch part and the outlet of the second branch part.

4 Claims, 11 Drawing Sheets

(56) References Cited

U.S. PATENT DOCUMENTS

| | | | | |
|---|---|---|---|---|
| 2017/0158363 | A1* | 6/2017 | Kropf | B65B 5/10 |
| 2019/0168901 | A1* | 6/2019 | Mueggenborg | B65D 88/26 |
| 2022/0306328 | A1* | 9/2022 | Otxoa-Aizpurua Calvo | B65B 37/14 |
| 2024/0228081 | A1* | 7/2024 | Nagashima | B65B 65/003 |

* cited by examiner

A-A ARROW VIEW

B-B ARROW VIEW

MULTILINE VERTICAL AUTOMATIC FILLING AND PACKAGING MACHINE AND HOPPER

BACKGROUND OF THE INVENTION

1. Field of the Invention

The present invention belongs to a technical field of an automatic packaging machine that automatically supplies and packages a filling material (a content or an object to be packaged) by using a packaging film (packaging material). More particularly, the present invention relates to a technology of a multiline vertical automatic filling and packaging machine (for example, a vertical stick (or a vertical pillow) filling and packaging machine) that forms each of band-shaped packaging films arranged side by side in a plurality of lines equal to or more than three lines into a substantially cylindrical shape so as to form an upwardly open packaging bag, supplies the content from an upper opening of the packaging bag, and performs lateral sealing on the packaging bag on an upper opening side to hermetically seal the packaging bag.

2. Description of the Related Art

Hitherto, when a filling material such as powder, granular matter, a solid, a pastry substance, or a liquid substance is to be automatically packaged with a packaging film so as to achieve vertical stick packaging for forming a stick-shaped packaging bag elongated in a longitudinal direction, there exists a multiline vertical automatic filling and packaging machine (for example, a multiline vertical stick packaging machine: hereinafter also referred to simply as "packaging machine") that simultaneously performs filling and packaging for a plurality of lines. In FIG. 9, there is illustrated an example of an internal structure of a packaging machine 1 of the above-mentioned kind.

As illustrated in FIG. 9, when, for example, two kinds of stick packaging bags (P16A and P16B), which contain different filling materials, respectively, are to be formed (produced) by using the packaging machine 1 and a predetermined number of the stick packaging bags of the respective kinds are to be packed into one box (for example, an assortment pack), the stick packaging bags have been packed as follows in the related art. Here, the term "assortment" means an assortment of items.

Specifically, hitherto, the following method has been used. The individual packaging bags P16A and P16B, which have been discharged from the packaging machine 1, are temporarily stored as individual packaging bags P17A and P17B in product transport boxes 114A and 114B in accordance with their kinds. Then, a worker manually takes out a predetermined number of the individual packaging bags from each of the product transport boxes 114A and 114B while counting the number of the individual packaging bags and then manually packs the thus taken-out individual packaging bags together (see FIG. 11).

In FIG. 9 and FIG. 11, the reference symbols P17A and P17B denote packaging bags stored in the product transport boxes 114A and 114B, respectively. The reference symbols P18A and P18B denote packaging bag groups (products). Each of the packaging bag groups P18A and P18B includes a predetermined number of packaging bags counted and taken out by the worker. In FIG. 11, one packaging bag group P18A including five packaging bags P17A and one packaging bag group P18B similarly including five packaging bags P17B are packed in a common (the same) box by the worker to thereby complete a product box P19.

Incidentally, in FIG. 9, two kinds of stick packaging bags (packaging bags P16A and P16B), each kind of packaging bags containing a different filling material, are exemplified. A packaging machine that produces each of the kinds of packaging bags in two lines is illustrated as an example. In this case, the packaging bag P16A and the packaging bag P16B are each produced in two lines (or a plurality of lines equal to or more than three lines) instead of being produced in one line in order to enhance productivity (the number of packaging bags being produced per unit time).

Further, as another method of making assortment packs, there has been known a method using an accumulating device for picking up a predetermined number of products for each of a plurality of kinds of products and packing the thus picked-up products into one box (assortment pack) (see Patent Literature 1).

Here, Patent Literature 1 is Japanese Patent No. 4100749.

When a predetermined number of packaging bags (P16A and P16B), each kind of packaging bags containing a different filling material, are picked up for each of the kinds and the thus picked-up packaging bags are packed together into one box (assortment pack), the packaging machine 1 is required to include hoppers 105 as illustrated in FIG. 10. The hoppers 105 include a hopper 105A that stores a filling material A11 and a hopper 105B that stores a filling material B11.

Further, when each of the packaging bags P16A and P16B is produced in two lines in order to enhance productivity (see FIG. 9), the hoppers 105 (hoppers 105A and 105B) having a configuration as illustrated in FIG. 10 are required.

As illustrated in FIG. 10, the hopper 105A that stores the filling material A11 and the hopper 105B that stores the filling material B11 have a bilaterally symmetrical relationship and have configurations similar to each other. Thus, here, the hopper 105A is representatively described.

The hopper 105A includes an upwardly open receiving part 105*a* and branch parts 105*b* and 105*c*. The upwardly open receiving part 105*a* has a substantially rectangular transverse cross section (hereinafter also referred to simply as "transverse cross section") taken along a horizontal plane being orthogonal to a plane in FIG. 10 and has an upper opening with a relatively large size (transverse sectional area). The branch parts 105*b* and 105*c* are bifurcated from a lower portion (downwardly in FIG. 10) of the upwardly open receiving part 105*a*.

Specifically, as illustrated in FIG. 10, the filling material A11, which has been fed via the upwardly open receiving part 105*a* and is stored in the hopper 105A (the upwardly open receiving part 105*a* and the branch parts 105*b* and 105*c*), is split through the branch parts 105*b* and 105*c* and supplied to intermediate chutes 107A1 and 107A2.

Here, as illustrated in FIG. 9 and FIG. 10, the packaging machine 1 includes a weighing and supplying device 106. The weighing and supplying device 106 supplies the filling material A11 to the intermediate chutes 107A1 and 107A2 while weighing the filling materials A11 supplied from the branch parts 105*b* and 105*c* of the hopper 105A, respectively.

As illustrated in FIG. 9, the packaging machine 1 includes four lines of filling pipes 103 and four lines of filling spouts 104. One elongated sheet of packaging film P11 is cut into a plurality of lines (four lines in FIG. 9) of packaging films P12, each having a smaller width, by a slit device 101. The packaging films P12 are wound around the filling pipes 103 to be each formed into a substantially cylindrical shape. The filling pipes 103 also serve as filling passages for the filling material (content). The filling spouts 104 allow the filling material to be supplied to the four lines of the filling pipes 103, around which the packaging films P12 are wound, from four lines of intermediate chutes 107 (107A1, 107A2, 107B1, and 107B2), respectively. In FIG. 9, the reference symbol 102 denotes a tension roller that applies tension to the packaging films P12.

Further, the packaging machine 1 includes vertical sealing devices 108. Each of the vertical sealing devices 108 overlaps a right end and a left end of the packaging film P12 wound around a corresponding one of the filling pipes 103 and bonds the overlapped right end and left end to each other to form a packaging film P13 having a cylindrical shape.

The packaging machine 1 further includes a lateral sealing device 109. The lateral sealing device 109 performs lower lateral sealing on the packaging film P13, which has been formed into a cylindrical shape by the vertical sealing device 108, to thereby form a packaging film P14 having a bag-like shape. After the packaging film P14 having a bag-like shape is filled with the filling material via the filling pipe 103, the lateral sealing device 109 performs lateral sealing on the packaging film P14 at a position higher than the previous lateral sealing to achieve hermetical sealing to thereby form a continuous packaging bag series P15.

Further, the packaging machine 1 includes a cutter device 110 and product slides 111. The cutter device 110 separates the continuous packaging bag series P15 including continuous (contiguous) packaging bags, each containing the filling material and being hermetically sealed by the lateral sealing device 109, into individual packaging bags P16. The product slides 111 allow the individual packaging bags P16 separated from each other by the cutter device 110 to be discharged from the packaging machine 1.

Then, in FIG. 9, the individual packaging bags P16 discharged through the product slides 111 are discharged as the packaging bags P17 into the product transport boxes 114A and 114B via discharge conveyors 113.

Here, after the individual packaging bags P16A and P16B discharged from the related-art packaging machine 1 described above are temporarily stored as the packaging bags P17 in the product transport boxes 114A and 114B so that each of the product transport boxes 114A and 114B stores the packaging bags P17 with the same kind of filling material, a worker manually picks up a predetermined number of the packaging bags P17 from each of the product transport boxes 114A and 114B while counting the number of the packaging bags P17 and manually puts the packaging bags P17 into a box to make an assortment pack. Thus, under such actual circumstances, miscounting (human error) is liable to occur.

Further, when an assortment pack is made by using the accumulating device as described in Patent Literature 1, for example, the following problem may arise. Specifically, the accumulating device is expensive and thus its introduction is not adequate in terms of costs, or there is no space for installing the accumulating device in a factory. Because of the problems described above, the accumulating device cannot be used. In the end, under the actual circumstances, the worker is required to count the number of packaging bags and manually make an assortment pack.

SUMMARY OF THE INVENTION

According to the present invention, there is provided a multiline vertical automatic filling and packaging machine configured to produce packaging bags by winding a plurality of lines equal to or more than three lines of packaging films being continuously conveyed, around outer peripheries of filling pipes, which are provided so as to extend in a vertical direction and are arranged in a plurality of lines corresponding to the plurality of lines of the packaging films, each into a substantially cylindrical shape, performing vertical sealing on a right end and a left end of each of the packaging films, the right end and the left end extending in a longitudinal direction of the packaging film, to form a cylindrical packaging film, performing lateral sealing on each of the cylindrical packaging films at a predetermined position to form an upwardly open packaging bag, supplying a filling material into the upwardly open packaging bags via the filling pipes, and performing lateral sealing on each of the cylindrical packaging bags at a position higher than the predetermined position to achieve sealing, the multiline vertical automatic c filling and packaging machine including:

a hopper A configured to store a filling material A and supply the filling material A to at least a corresponding one of the plurality of lines of the filling pipes; and a hopper B configured to store a filling material B and supply the filling material B to at least a corresponding one of the plurality of lines of the filling pipes, wherein the hopper A includes:

an upwardly open receiving part having an upper opening with a relatively large transverse sectional area taken in a horizontal direction; and a first branch part and a second branch part bifurcated from a lower portion of the upwardly open receiving part, the first branch part and the second branch part each having a smaller transverse sectional area in the horizontal direction than the transverse sectional area of the upwardly open receiving part in the horizontal direction, wherein the first branch part has an outlet and the second branch part has an outlet, and each of the outlets allows the filling material A to be supplied to at least a corresponding one of the plurality of lines of the filling pipes, and wherein one of the first branch part or the second branch part is extended in a direction of arrangement of the plurality of lines of the filling pipes so that at least one of the filling pipes that allows supply of the filling material B supplied from the hopper B is located between the filling pipe corresponding to the outlet of the first branch part and the filling pipe corresponding to the outlet of the second branch part in the direction of arrangement of the plurality of lines of the filling pipes.

Further, in the multiline vertical automatic filling and packaging machine according to the present invention, wherein the hopper B may include:

an upwardly open receiving part having an upper opening with a relatively large transverse sectional area in a horizontal direction; and a third branch part and a fourth branch part bifurcated from a lower portion of the upwardly open receiving part, the third branch part and the fourth branch part each having a smaller transverse sectional area in the horizontal direction than the transverse sectional area of the upwardly open receiving part in the horizontal direction, wherein the third branch part may have an outlet and the fourth branch part may have an outlet, and each of the outlets allows the filling material B to be supplied to at least a corresponding one of the plurality of lines of the filling pipes, wherein one of the third branch part or the fourth branch part may be extended in the direction of arrangement of the plurality of lines of the filling pipe so that at least one of the filling pipes that allows supply of the filling material A supplied from the hopper A is located between the filling pipe corresponding to the outlet of the third branch part and the filling pipe corresponding to the outlet of the fourth branch part in the direction of arrangement of the plurality of lines of the filling pipes, and wherein the hopper A and the hopper B may be arranged so that the branch parts, each being extended in the direction of arrangement of the plurality of lines of the filling pipes, face each other.

In addition, according to the present invention, there is provided a hopper configured to store a filling material and supply the filling material to filling pipes, the hopper to be used for a multiline vertical automatic filling and packaging machine configured to produce packaging bags by winding a plurality of lines equal to or more than three lines of packaging films being continuously conveyed, around outer peripheries of filling pipes, which are provided so as to extend in a vertical direction and are arranged in a plurality of lines corresponding to the plurality of lines of the packaging films, each into a substantially cylindrical shape, performing vertical sealing on a right end and a left end of each of the packaging films, the right end and the left end extending in a longitudinal direction of the packaging film, to form a cylindrical packaging film, performing lateral sealing on each of the cylindrical packaging films at a predetermined position to form an upwardly open packaging bag, supplying a filling material into the upwardly open packaging bags via the filling pipes, and performing lateral sealing on each of the cylindrical packaging bags at a position higher than the predetermined position to achieve sealing, the hopper including:

an upwardly open receiving part having an upper opening with a relatively large transverse sectional area in a horizontal direction; and a first branch part and a second branch part bifurcated from a lower portion of the upwardly open receiving part, the first branch part and the second branch part each having a smaller transverse sectional area in the horizontal direction than the transverse sectional area of the upwardly open receiving part in the horizontal direction, wherein the first branch part has an outlet and the second branch part has an outlet, and each of the outlets allows the filling material to be supplied to at least a corresponding one of the plurality of lines of the filling pipes, and wherein one of the first branch part or the second branch part is extended in a direction of arrangement of the plurality of lines of the filling pipes so that at least one of the filling pipes that allows supply of a filling material supplied from another hopper is located between the filling pipe corresponding to the outlet of the first branch part and the filling pipe corresponding to the outlet of the second branch part in the direction of arrangement of the plurality of lines of the filling pipes.

Further, according to the present invention, there is provided a hopper configured to store a filling material and supply the filling material to filling pipes, the hopper to be used for a multiline vertical automatic filling and packaging machine configured to produce packaging bags by winding a plurality of lines equal to or more than three lines of packaging films being continuously conveyed, around outer peripheries of filling pipes, which are provided so as to extend in a vertical direction and are arranged in a plurality of lines corresponding to the plurality of lines of the packaging films, each into a substantially cylindrical shape, performing vertical sealing on a right end and a left end of each of the packaging films, the right end and the left end extending in a longitudinal direction of the packaging film, to form a cylindrical packaging film, performing lateral sealing on each of the cylindrical packaging films at a predetermined position to form an upwardly open packaging bag, supplying a filling material into the upwardly open packaging bags via the filling pipes, and performing lateral sealing on each of the cylindrical packaging bags at a position higher than the predetermined position to achieve sealing, the hopper including:

an upwardly open receiving part having an upper opening with a relatively large transverse sectional area in a horizontal direction; and a first branch part and a second branch part bifurcated from a lower portion of the upwardly open receiving part, the first branch part and the second branch part each having a smaller transverse sectional area in the horizontal direction than the transverse sectional area of the upwardly open receiving part in the horizontal direction, wherein the first branch part may have an outlet and the second branch part may have an outlet, and each of the outlets allows the filling material to be supplied to at least a corresponding one of the plurality of lines of the filling pipes, wherein one of the first branch part or the second branch part may be extended in a direction of arrangement of the plurality of lines of the filling pipes so that at least one of the filling pipes that allows supply of a filling material supplied from another hopper is located between the filling pipe corresponding to the outlet of the first branch part and the filling pipe corresponding to the outlet of the second branch part in the direction of arrangement of the plurality of lines of the filling pipes, and wherein, independently of the hopper, a hopper having the same configuration as that of the hopper is arranged so that branch parts on a side of extending in the direction of the arrangement of the plurality of lines of the filling pipes face each other.

DESCRIPTION OF THE EMBODIMENTS

Now, a multiline vertical automatic filling and packaging machine (automatic filling and packaging machine) according to an embodiment of the present invention is described with reference to the attached drawings. Note that, the present invention is not limited to the embodiment described below.

The present invention has been made in view of the actual circumstances described above, and has an object to provide a multiline vertical automatic filling and packaging machine having multiple lines equal to or more than three lines including lines for supplying one kind of filling material and a line for supplying a different kind of filling material in which the line for supplying the different kind of filling material can be arranged between the lines for the one kind of filling material, which has a configuration at low cost and maintains productivity for packaging bags without impairing workability at the time of supplying (feeding) the filling material into a hopper, and the hopper used for the multiline vertical automatic filling and packaging machine.

In embodiments of the present invention, the following multiline vertical automatic filling and packaging machine is representatively described as the automatic filling and packaging machine according to the present invention. Specifically, the multiline vertical automatic filling and packaging machine produces a packaging bag, for example, by cutting one elongated sheet of packaging film being continuously conveyed at a predetermined speed into a plurality of lines equal to or more than three lines of packaging films, each having a smaller width, winding the packaging films around outer peripheries of filling pipes, which are provided so as to extend in a vertical direction and are arranged in a plurality of lines corresponding to the plurality of lines of packaging films, so that each of the packaging films is formed into a substantially cylindrical shape, performing vertical sealing on a right end and a left end of each of the packaging films, the right end and the left end extending in a longitudinal direction, to form a cylindrical packaging film, performing lateral sealing on each of the cylindrical packaging films at a predetermined position to form an upwardly open packaging bag, supplying a filling material into the upwardly open packaging bags via the filling pipes, and performing lateral sealing on the cylindrical packaging bag at a position higher than the previous lateral sealing to achieve upper lateral sealing. However, the present invention is not limited to the multiline vertical automatic filling and packaging machine described above.

Figure 1:
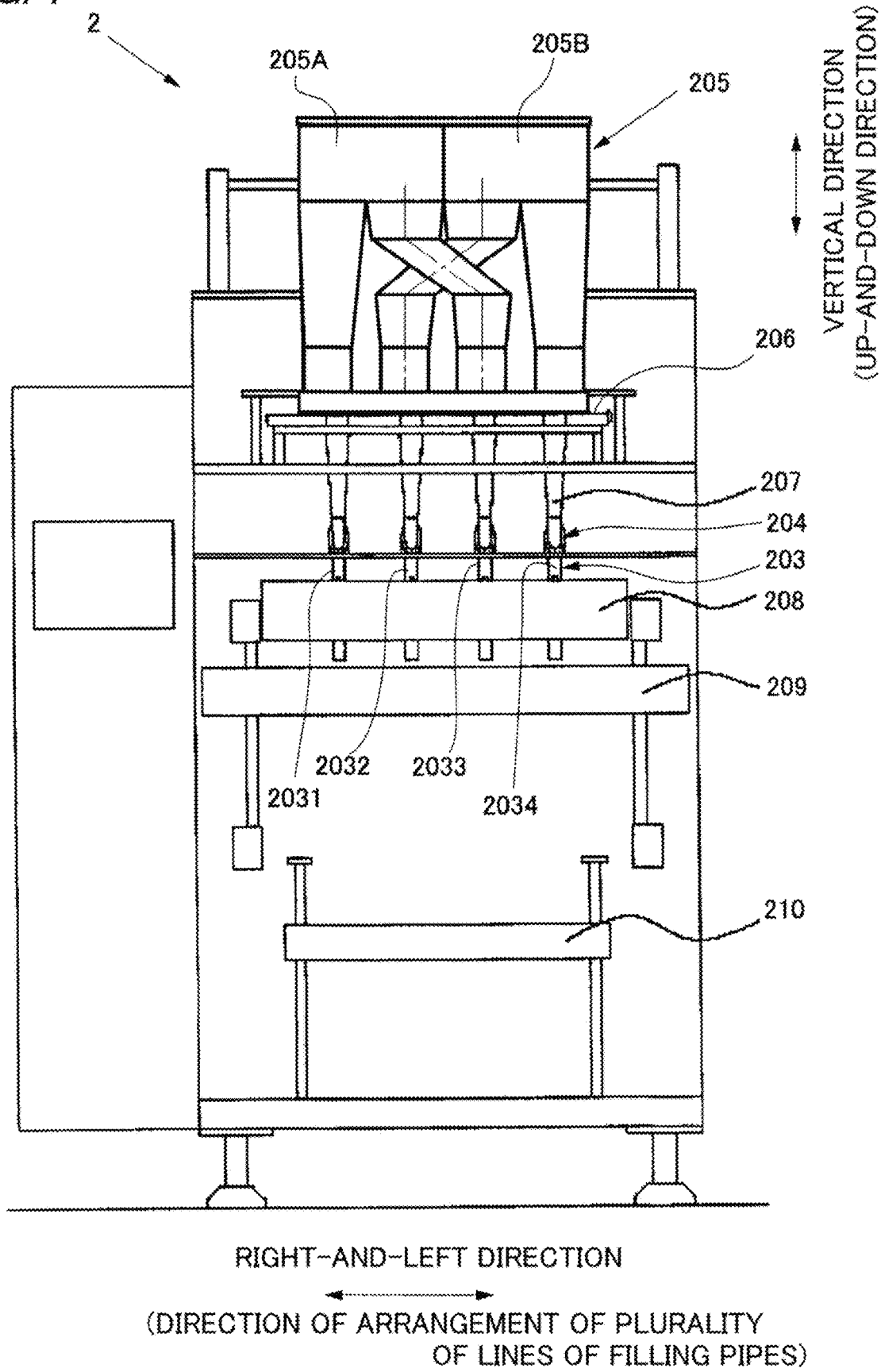
FIG. 1 is a front view for illustrating one configuration example of a multiline vertical automatic filling and packaging machine (automatic filling and packaging machine) according to an embodiment of the present invention.
Figure 2:
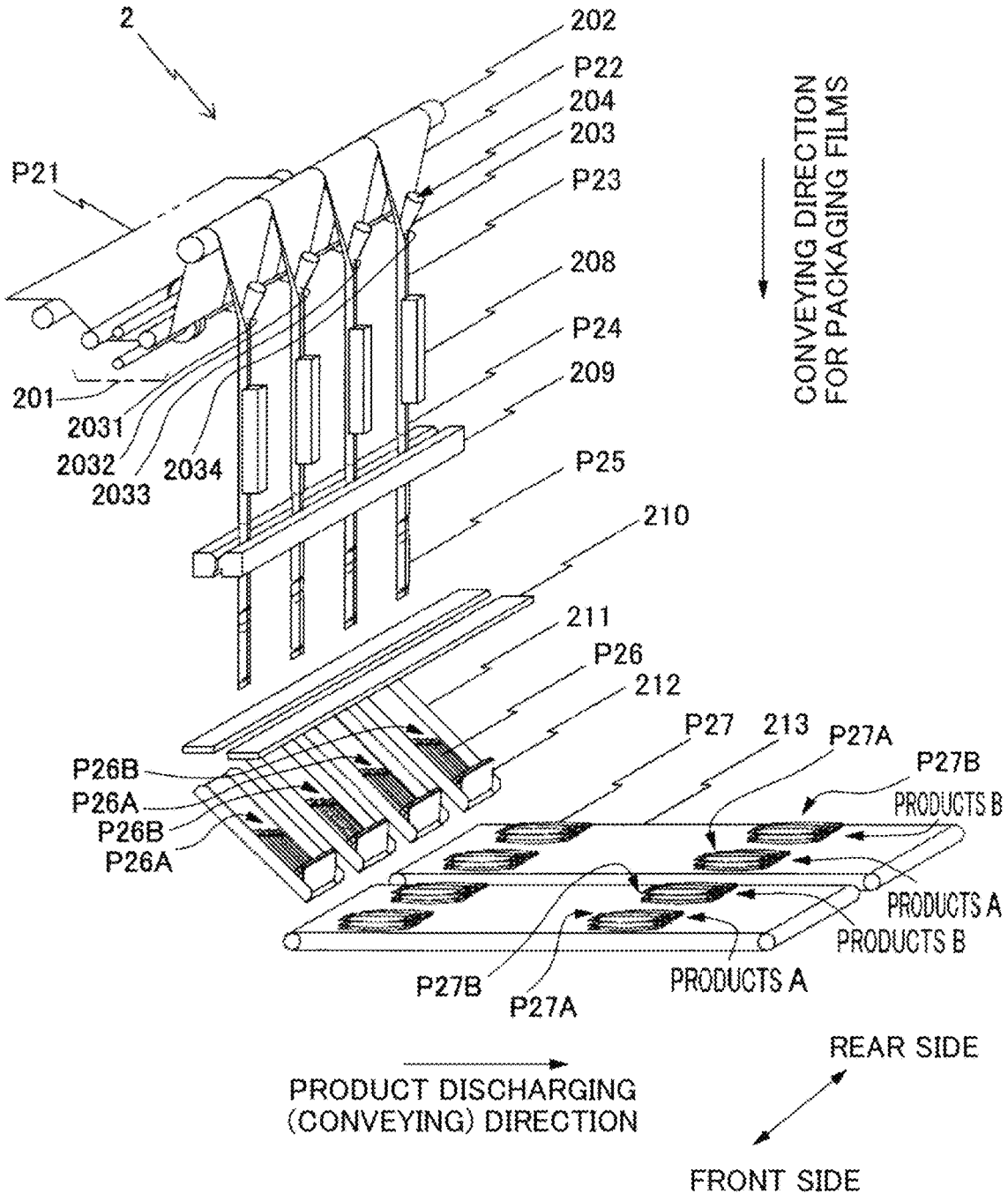
FIG. 2 is a perspective view for illustrating filling and packaging parts extracted from the automatic filling and packaging machine.

FIG. 1 is a front view of a multiline vertical automatic filling and packaging machine (multiline vertical stick filling and packaging machine: automatic filling and packaging machine) 2 according to an embodiment of the present invention. FIG. 2 is a perspective view of filling and packaging parts extracted from the automatic filling and packaging machine 2 of FIG. 1. The multiline vertical stick filling and packaging machine denoted by the reference symbol 2 in FIG. 1 and FIG. 2 is configured to be able to continuously produce four stick packaging bags (vertical pillow-type packaging bags) in four lines in parallel at one time.

As illustrated in FIG. 2, the automatic filling and packaging machine 2 includes four lines of hollow filling pipes 203 and four lines of hollow filling spouts 204. One elongated sheet of packaging film P21 having a large width is cut into a plurality of lines (four lines (four elongated sheets) in FIG. 2) of packaging films P22, each having a smaller width, by a slit device 201. The packaging films P22 are wound around the filling pipes 203 to each form a substantially cylindrical shape and are thus formed into packaging films P23, each having a substantially cylindrical shape. The filling pipes 203 also serve as filling passages for filling materials (contents). The filling spouts 204 allow the filling materials to be supplied to the filling pipes 203 from four lines of hollow intermediate chutes 207 (207A1, 207B1, 207A2, and 207B2). In FIG. 2, the reference symbol 202 denotes a tension roller that applies tension to the packaging films.

Figure 3:
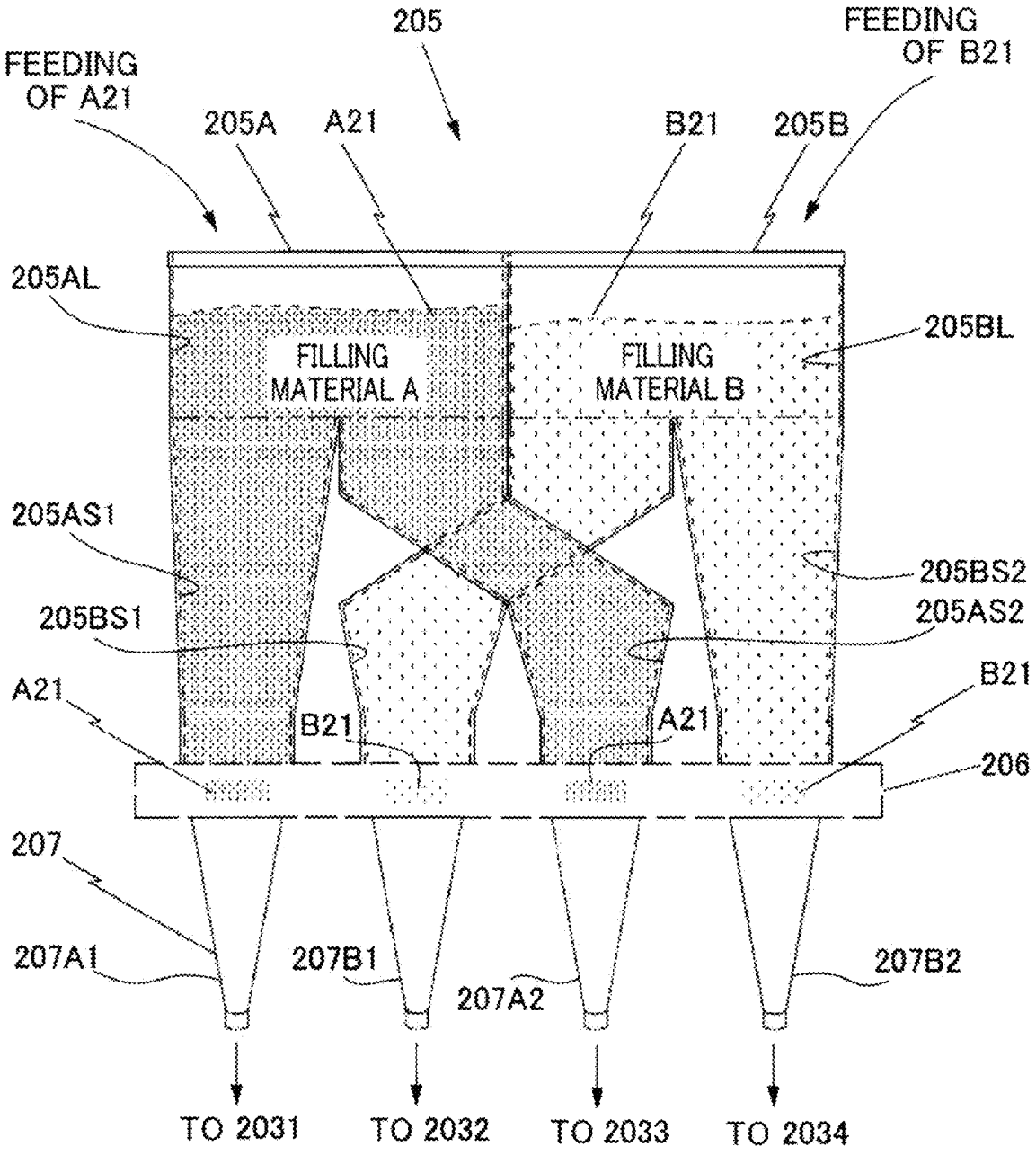
FIG. 3 is a sectional view of one configuration example of hoppers and intermediate chutes of the automatic filling and packaging machine when viewed from a front side.

In this embodiment, as illustrated in FIG. 3, the intermediate chutes 207A1, 207B1, 207A2, and 207B2 are arranged in the stated order from a left side in FIG. 3. The intermediate chutes 207A1 and 207A2 allow supply of a filling material A21. The intermediate chutes 207B1 and 207B2 allow supply of a filling material B21.

As illustrated in FIG. 1 and FIG. 3, the reference symbol 206 denotes a weighing and supplying device, which has a configuration similar to that of the weighing and supplying device 106.

Further, as illustrated in FIG. 2, the automatic filling and packaging machine 2 includes vertical sealing devices 208. Each of the vertical sealing devices 208 overlaps and bonds a right end and a left end of the packaging film P23 wound (wrapped) around a periphery of a corresponding one of the filling pipes 203 to thereby form a packaging film P24 having a cylindrical shape.

Further, the automatic filling and packaging machine 2 includes a lateral sealing device 209. The lateral sealing device 209 performs lower lateral sealing on the packaging film P23, which has been formed into a cylindrical shape by the vertical sealing device 208, to form a bag-like shape to thereby form a packaging film P24 having a bag-like shape. After the filling material is supplied into the packaging film P24 via the filling pipe 203, the lateral sealing device 209 performs upper lateral sealing on the packaging film P24 to perform hermetical sealing to thereby form a continuous packaging bag series P25.

The packaging film P24 having a cylindrical shape is continuous. Thus, the upper lateral sealing performed by the lateral sealing device 209 according to this embodiment on the packaging film P24 (lateral sealing on a downstream side in a conveying direction for the packaging film) at a position corresponding to an upper end of a preceding individual packaging bag P26 described later also serves as the lower lateral sealing on the packaging film P24 (lateral sealing on an upstream side in the conveying direction for the packaging film) at a position corresponding to a lower end portion of a subsequent individual packaging bag P26 that is adjacent to and follows the preceding individual packaging bag P26.

Further, the automatic filling and packaging machine 2 includes a cutter device 210 and product slides 211. The cutter device 210 cuts the continuous packaging bag series P25 including the packaging bags, each containing the filling material, into the individual packaging bags P26. Each of the product slides 211 allows the thus separated individual packaging bags P26 to be discharged from a main body of the automatic filling and packaging machine 2.

In FIG. 2, the reference symbol P26A denotes each of individual packaging bags that contains the filling material A21 (having the filling material A21 as its content), and the reference symbol P26B denotes each of individual packaging bags that contains the filling material B21 (having the filling material B21 as its content).

The automatic filling and packaging machine 2 includes measuring stoppers 212. Each of the measuring stoppers 212 is provided to a lower part of a sliding surface of a corresponding one of the product slides 211. When the number of individual packaging bags P26 accumulated on the sliding surface of the product slide 211 reaches a predetermined number, a corresponding one of the measuring stoppers 212 opens its gate.

Thus, when the number of individual packaging bags P26 on the product slide 211 reaches the predetermined number, the gate of the measuring stopper 212 is opened. Thus, in this embodiment, as illustrated in FIG. 2, the predetermined number of individual packaging bags P26 are put together into a group (one set of five individual packaging bags) of individual packaging bags P27, and groups of the individual packaging bags P27 are placed on upper surfaces of discharge conveyors 213.

Here, in this embodiment, the groups of the individual packaging bags P27 are placed on the upper surfaces of the discharge conveyors 213 in the following order. The group of the individual packaging bags P27A containing the filling material A21 is placed as a first group from a front side in FIG. 2, the group of the individual packaging bags P27B containing the filling material B21 is placed as a second group from the front side in FIG. 2, the group of the individual packaging bags P27A is placed as a third group from the front side in FIG. 2, and the group of the individual packaging bags P27B is placed as a fourth group from the front side (on a rear side) in FIG. 2.

Figure 4:
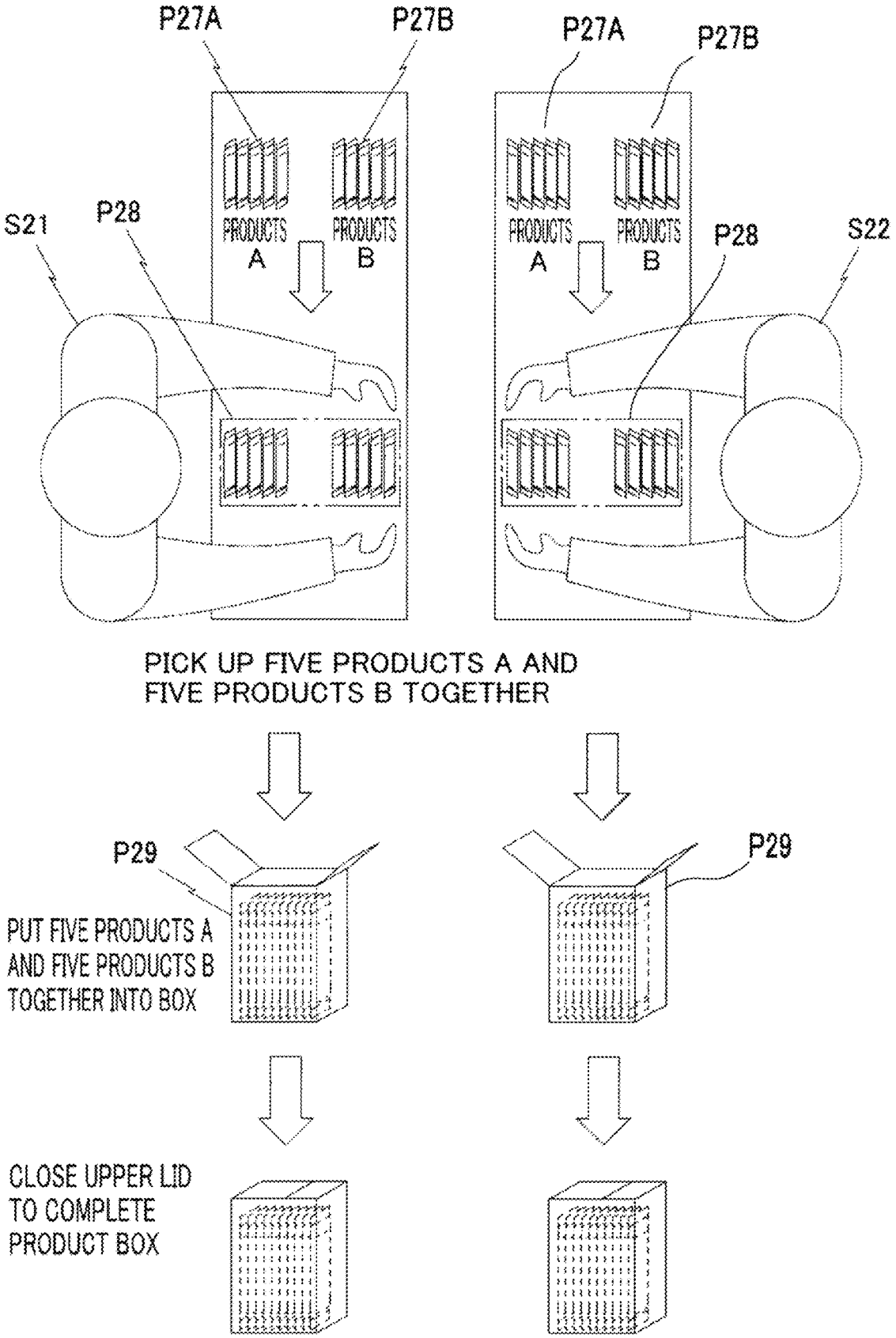
FIG. 4 is an explanatory view for illustrating one example of a boxing-up operation for making assortment packs, which is performed by workers, according to the embodiment.

Thus, in this embodiment, as illustrated in FIG. 4, a worker S21 can take out (pick up) a product group P28 including one set of five products A (P27A) and one set of five products B (P27B) as one group (one set) without counting the number of individual packaging bags P27. After putting the thus taken-out product group P28 into a box without counting the number of individual packaging bags, the worker closes a lid of the box to thereby complete a product box P29.

Further, similarly, a worker S22 facing the worker S21 can take out (pick up) a product group P28 including one set of five products A (P27A) and one set of five products B (P27B) as one group (one set) without counting the number of individual packaging bags P27. After putting the thus taken-out product group P28 into a box without counting the number of individual packaging bags, the worker closes a lid of the box to thereby complete a product box P29.

Specifically, according to this embodiment, the products packaged by the automatic filling and packaging machine 2 can be discharged in a way that meets various requests. Hence, an operation that is more liable to cause an error, for example, a manual counting operation performed by a worker, can be eliminated, thus contributing to achievement of an assortment packing operation with fewer errors (human errors).

Here, in this embodiment, as illustrated in FIG. 3, the intermediate chutes 207A1 and 207A2 that allow supply of the filling material A21 and the intermediate chutes 207B1 and 207B2 that allow supply of the filling material B21 are configured so that the intermediate chutes 207A1, 207B1, 207A2, and 207B2 are arranged in the stated order from the left side in FIG. 2 and FIG. 3.

An upper part of the intermediate chute 207A1 and an upper part of the intermediate chute 207A2 are connected to branch parts 205AS1 and 205AS2 of a hopper 205A in which the filling material A21 is stored, respectively. An upper part of the branch part 205AS1 and an upper part of the branch part 205AS2 are connected to the same upwardly open receiving part 205AL.

The upwardly open receiving part 205AL has a relatively large upper opening (transverse sectional area).

Here, the branch parts 205AS1 and 205AS2 correspond to one example of a first branch part and a second branch part according to the present invention.

Further, an upper part of the intermediate chute 207B1 and an upper part of the intermediate chute 207B2 are connected to branch parts 205BS1 and 205BS2 of a hopper 205B in which the filling material B21 is stored, respectively. An upper part of the branch part 205BS1 and an upper part of the branch part 205BS2 are connected to the same upwardly open receiving part 205BL. The upwardly open receiving part 205BL has a relatively large upper opening (transverse sectional area).

Here, the branch parts 205BS1 and 205BS2 correspond to one example of a third branch part and a fourth branch part according to the present invention.

In FIG. 5, one example of a configuration of the hoppers 205 (205A and 205B) according to this embodiment is illustrated. The hoppers corresponding to the hoppers 205A and 205B in a combined state are denoted by the reference symbol 205.

Figure 5A:
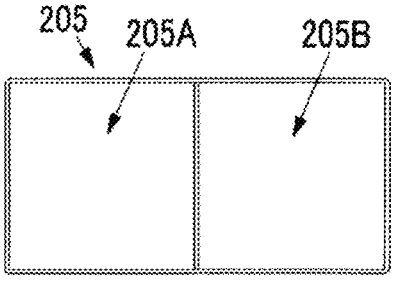
FIG. 5A is a plan view of the hoppers (205) according to the embodiment.
Figure 5B:
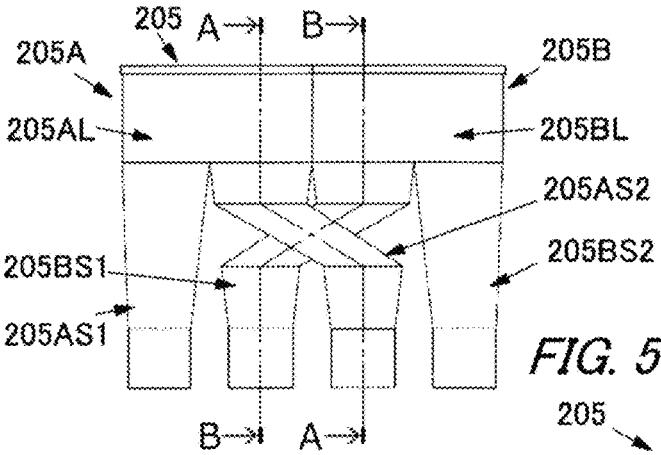
FIG. 5B is a front view of the hoppers (205)
Figure 5C:
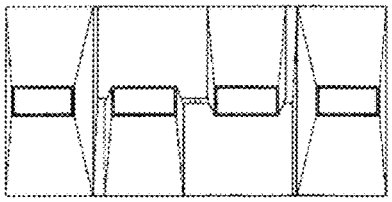
FIG. 5C is a bottom view of the hoppers (205)
Figure 5D:
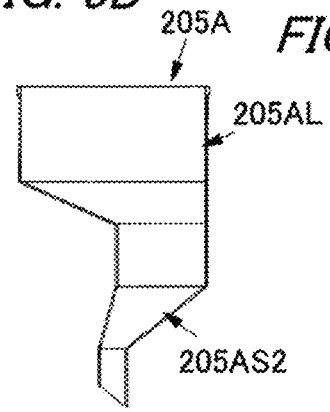
FIG. 5D is a sectional view taken along the line A-A of FIG. 5B as viewed in a direction of the arrows.
Figure 5E:
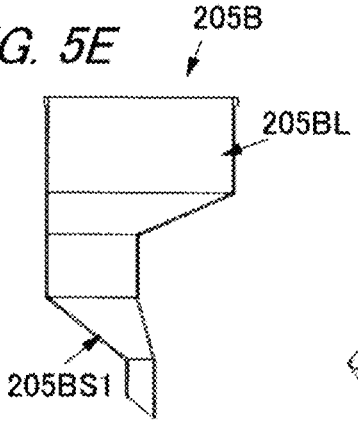
FIG. 5E is a sectional view taken along the line B-B of FIG. 5B as viewed in a direction of the arrows.
Figure 5F:
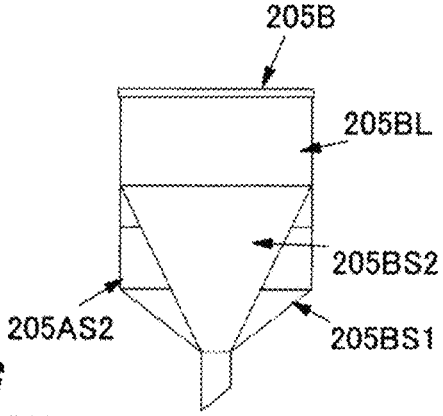
FIG. 5F is a right side view of FIG. 5B.
Figure 5G:
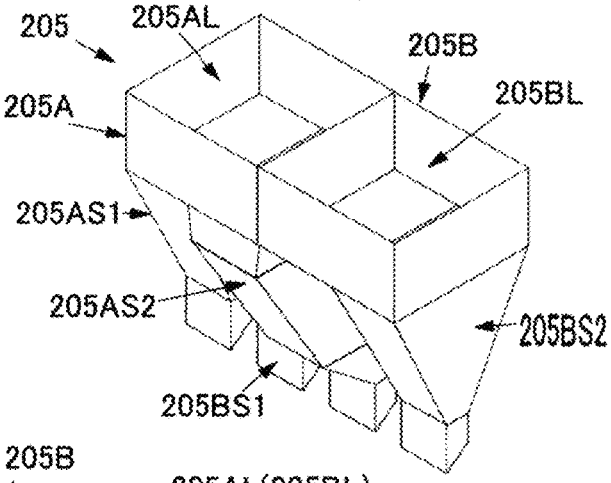
FIG. 5G is a perspective view of the hoppers (205) as viewed from diagonally above.
Figure 5H:
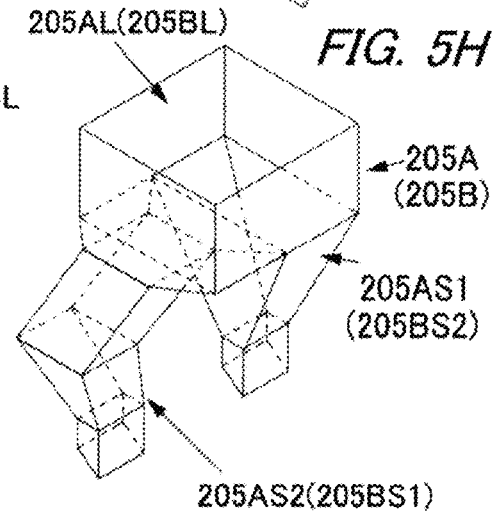
FIG. 5H is a perspective view of the hopper (205A or 205B) alone as viewed from diagonally above.

FIG. 5A is a plan view of the hoppers 205 (205A and 205B). FIG. 5B is a front view of the hoppers 205 (205A and 205B). FIG. 5C is a bottom view of the hoppers 205 (205A and 205B). FIG. 5D is a sectional view of the hopper 205A, which is taken along the line A-A as viewed in a direction of the arrows. FIG. 5E is a sectional view of the hopper 205B, which is taken along the line B-B as viewed in a direction of the arrows. FIG. 5F is a right side view of FIG. 5B. FIG. 5G is a perspective view of the hoppers 205 as viewed from diagonally above. FIG. 5H is a perspective view of the hopper 205A (or 205B) alone as viewed from diagonally above.

Here, the hoppers 205A and 205B correspond to one example of hoppers A and B according to the present invention.

As illustrated in FIG. 3 and FIG. 5, the hopper (205A) includes: the upwardly open receiving part 205AL having an upper opening with a relatively large transverse sectional area in a horizontal direction; and the first branch part (205AS1) and the second branch part (205AS2), which are bifurcated from a lower portion (or lower end portion) of the upwardly open receiving part 205AL and each have a smaller transverse sectional area in the horizontal direction than the transverse sectional area of the upwardly open receiving part. The first branch part (205AS1) and the second branch part (205AS2) allow the filling material A (A21) to be supplied to corresponding ones (2031 and 2033) of the plurality of lines of the filling pipes from outlets of the first branch part (205AS1) and the second branch part (205AS2), and the first branch part (205AS1) or the second branch part (205AS2) is extended in a direction of arrangement of the plurality of lines of the filling pipes (a right-and-left direction, a lateral direction) so that at least one (2032) of the filling pipes for supplying the filling material B (B21) supplied from the hopper (205B) is located between the outlet of the first branch part (205AS1) and the outlet of the second branch part (205AS2) in the direction of arrangement of the plurality of lines of the filling pipes.

The hopper 205B has the same configuration as that of (is the same as) the hopper 205A. When the hopper 205A and the hopper 205B are combined (arranged) so that the branch parts (the second branch part (205AS2) and the branch part (205BS1: the third branch part according to the present invention) of the hopper B in FIG. 3 and FIG. 5), which are extended in the direction of arrangement of the plurality of lines of the filling pipes, face each other, the hoppers 205 are formed.

Here, as the hoppers 205, the hopper 205A and the hopper 205B may have an integral configuration, or the hopper 205A and the hopper 205B may have separable independent configurations.

In this embodiment, as an exemplification illustrated in FIG. 3 and FIG. 5, the hopper 205A and the hopper 205B are identical with each other, the upwardly open receiving part 205AL and the upwardly open receiving part 205BL correspond to each other as being identical, the first branch part (205AS1) of the hopper A and the branch part (205BS2: the fourth branch part according to the present invention) of the hopper B correspond to each other as being identical, and the second branch part (205AS2) of the hopper A and the branch part (205BS1: the third branch part according to the present invention) of the hopper B correspond to each other as being identical.

Here, the hopper 205A and the hopper 205B have been described as being identical with each other. However, the hoppers of the present invention are not limited to those described above. The hopper 205A and the hopper 205B may have different sizes, shapes, or the like while maintaining the same components (the same configuration) as long as the object, actions, and effects of the present invention can be achieved to a predetermined extent.

As is also understood from FIG. 5, the upwardly open receiving part 205AL (205BL) has a larger upper opening than each of those of the branch parts 205AS1 and 205AS2 (or 205BS1 and 205BS2). Thus, such an upwardly open receiving part 205AL (205BL) does not impair workability at the time of supplying (feeding) the filling material A21 (B21) into the hopper 205A (205B), and thus contributes to providing the automatic filling and packaging machine with high workability, which is easy to use.

As described above, the upwardly open receiving part 205AL (205BL) has a configuration with a relatively large upper opening, and two branch parts 205AS1 and 205AS2 (205BS1 and 205BS2) are connected to a lower portion of the upwardly open receiving part 205AL (205BL). The reason for this configuration is because workability is lowered at the time of feeding the filling material A21 (B21) into the hopper 205A (205B) without a large upper opening.

Specifically, with the upper opening having a smaller area, when the worker feeds the filling material (for example, A21) into the hopper 205A, it is required to pay close attention not to allow the filling material (for example, A21) to enter the hopper 205B that is provided adjacent to the hopper 205A and stores a different kind of filling material (B21). Further, the worker is required to carefully work so as to prevent the filling material from spilling around. As a result, it takes a longer time for the worker to feed a predetermined amount of filling material into the hopper, and hence the workability is lowered under the actual circumstances. Thus, it is required that this problem be prevented.

Thus, in this embodiment, in comparison to a case in which upper parts of the intermediate chutes 207A1 and 207A2 are connected to hoppers being independent of each other, each having a smaller upper opening area, the upper opening area can be remarkably increased. As a result, in this embodiment, at least one (2032) of the filling pipes for supplying the filling material B (B21) can be arranged so as to be located between the line of the filling pipe 2031 and the line of the filling pipe 2033, each for supplying the filling material A (A21), without impairing the workability at the time of supplying (feeding) the filling material into the hopper. Hence, the above-mentioned configuration and arrangement can contribute to providing the automatic filling and packaging machine, which is easy to use and enables achievement of improvement of a degree of freedom in a way of discharging (discharge layout) products (packaging bags), and the hopper used for the automatic filling and packaging machine.

Figure 10:
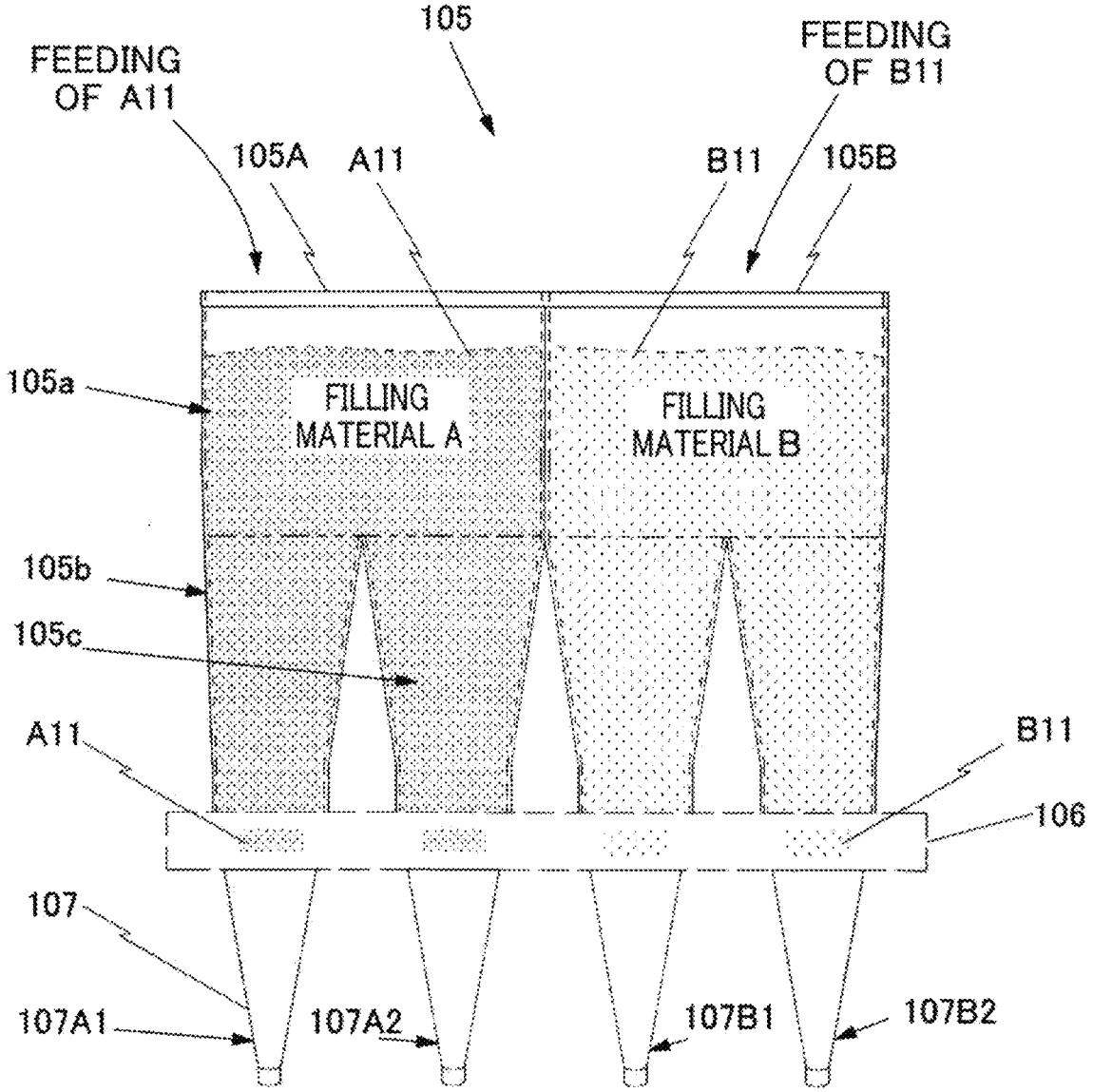
FIG. 10 is a sectional view of one configuration example of hoppers and intermediate chutes of the related-art automatic filling and packaging machine when viewed from a front side.
Figure 11:
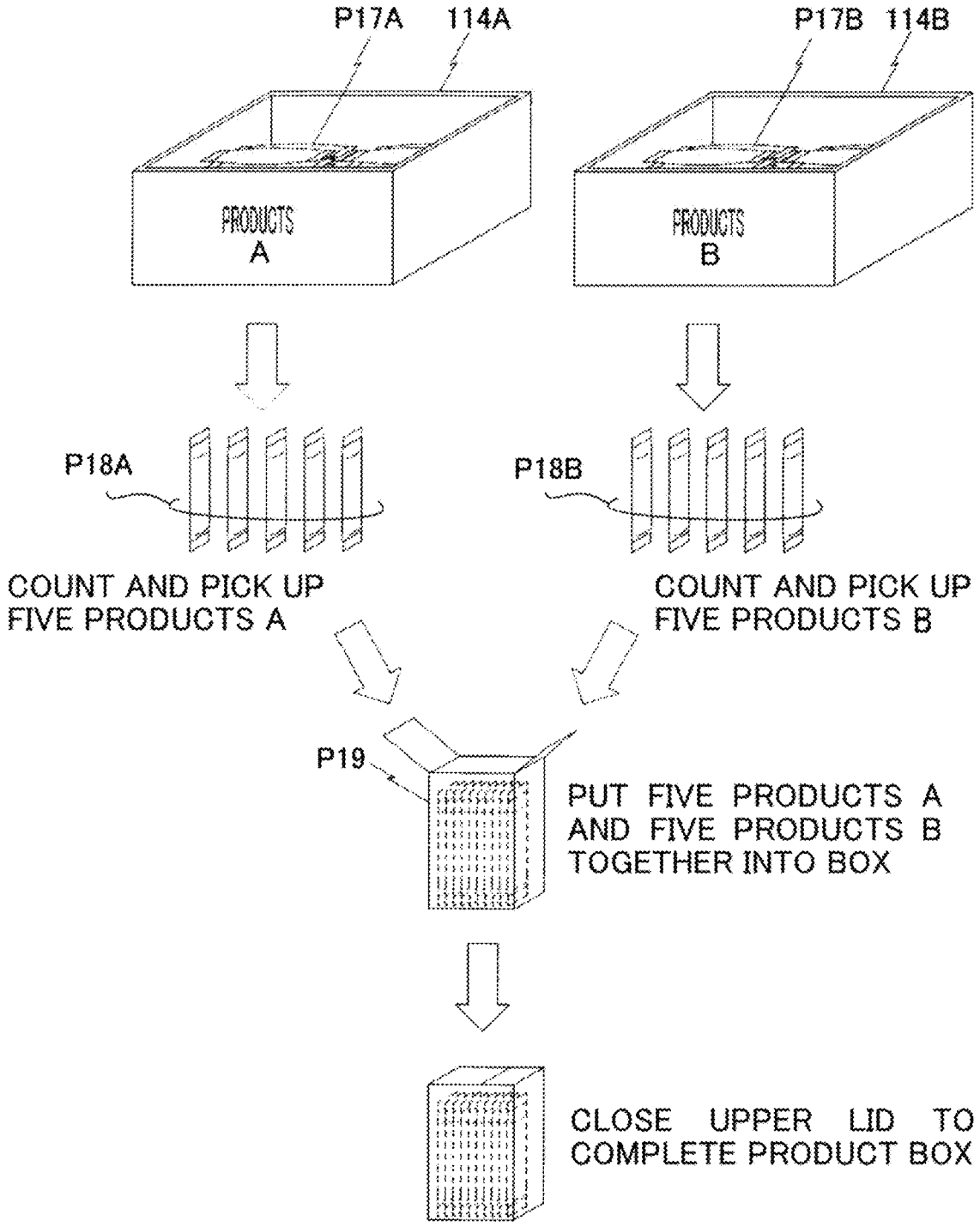
FIG. 11 is an explanatory view for illustrating one example of a boxing-up operation for making assortment packs, which is performed by a worker with the related-art automatic filling and packaging machine.

Further, the hoppers 205 are only required to replace the hoppers 105 in the automatic filling and packaging machine including the related-art hoppers 105 mounted therein as illustrated in FIG. 10. Thus, such a configuration can increase a degree of freedom in the way of discharging products at low cost, and thus can contribute to providing the automatic filling and packaging machine that is easy to use.

As described above, according to this embodiment, the related-art hoppers 105 are merely replaced by the hoppers 205 according to this embodiment. As a result, for example, when filling and packaging are performed in four lines in parallel, the production can be performed with a configuration at low cost including the lines for supplying one kind of filling material and the lines for supplying a different kind of filling material, which are arranged alternately, while maintaining productivity for the packaging bags without impairing workability at the time of supplying (feeding) the filling materials into the hoppers. Thus, according to this embodiment, the multiline vertical automatic filling and packaging machine and the hopper, which are easy to use and can contribute to the achievement of the way of discharging (discharge layout of) products (packaging bags) in accordance with, for example, a request from a factory, can be provided.

In this embodiment, as illustrated in FIG. 2 and FIG. 4, the stick-shaped packaging bags (packaging bags P27A and P27B), each containing different filling materials (contents, materials to be packaged), have been exemplified, and the packaging machine that produces each type of the packaging bags in two line has been described as an example. Each of the packaging bag P27A and the packaging bag P27B is produced in two lines instead of being produced in one line, and hence productivity (the number of packaging bags produced per unit time) can be enhanced.

Specifically, according to this embodiment, the multiline vertical automatic filling and packaging machine has multiple lines equal to or more than three lines including the lines for supplying one kind of filling material and the line for filling a different kind of filling material, in which the line for filling the different kind of filling material can be arranged between the lines for supplying the one kind of filling material. Thus, the multiline vertical automatic filling and packaging machine having a configuration at low cost, which does not impair the workability at the time of supplying (feeding) the filling materials into the hoppers while maintaining the productivity for the packaging bags, and the hopper used for the multiline vertical automatic filling and packaging machine can be provided.

Subsequently, a second embodiment is described.

Figure 6:
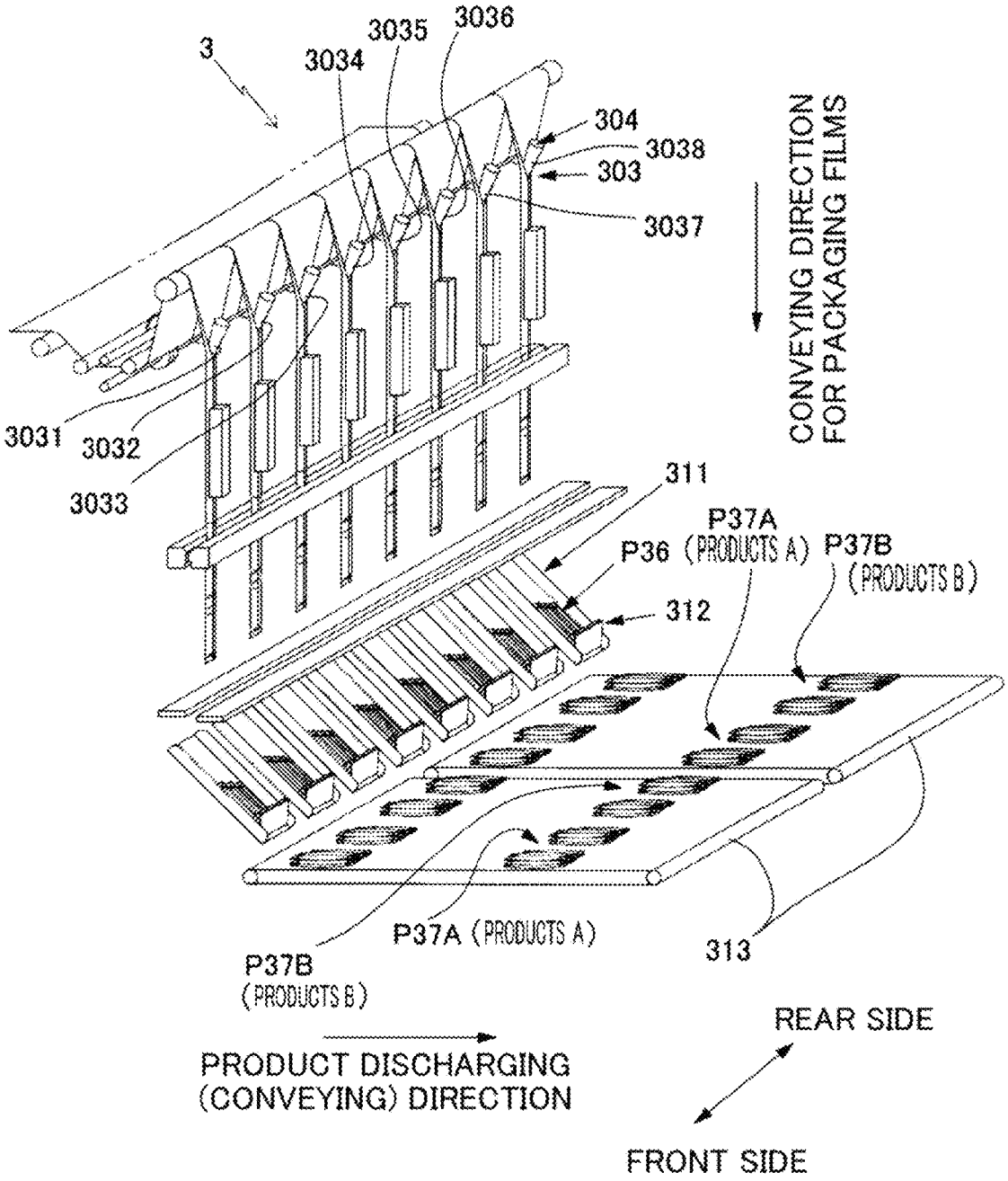
FIG. 6 is a perspective view for illustrating filling and packaging parts extracted from an automatic filling and packaging machine according to a second embodiment of the present invention.

In FIG. 6, a multiline vertical stick filling and packaging machine (automatic filling and packaging machine) 3 according to the second embodiment is described. The automatic filling and packaging machine 3 is configured to be able to continuously seal and form eight stick packaging bags (vertical pillow-shaped packaging bags) in eight lines in parallel at one time. A basic configuration of the automatic filling and packaging machine 3 is the same as that of the example illustrated in FIG. 2, and thus only different parts are described.

As illustrated in FIG. 6, the automatic filling and packaging machine 3 includes eight lines of hollow filling pipes 303 and eight lines of hollow filling spouts 304. The filling pipes 303 form eight lines (eight elongated sheets) of packaging films, which are wound therearound to each form a substantially cylindrical shape, into substantially cylindrical packaging films and also serve as filling passages for filling materials. The filling spouts 304 allow the filling materials to be fed into the filling pipes 303 via eight lines of hollow intermediate chutes 307.

Figure 7:
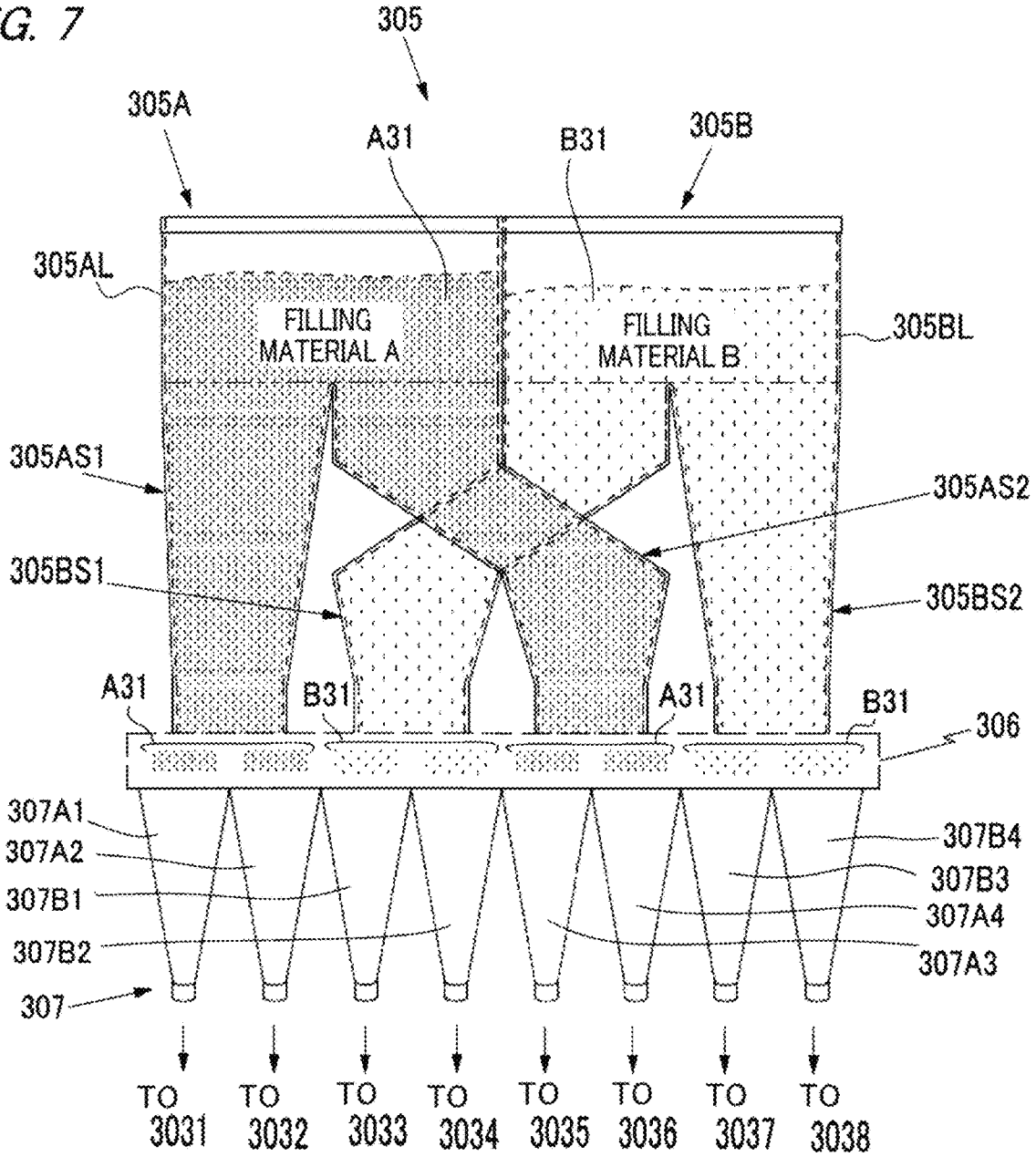
FIG. 7 is a sectional view for illustrating one configuration example of hoppers and intermediate chutes of the automatic filling and packaging machine.

In this embodiment, as illustrated in FIG. 7, hoppers having the same configurations as those of the hoppers 205 according to the first embodiment are used. Specifically, hoppers 305A and 305B correspond to one example of the hoppers A and B according to the present invention.

In this embodiment, however, as illustrated in FIG. 7, after a filling material A31 supplied from a branch part 305AS1 is split into two lines and weighed in a weighing and supplying device 306, the filling materials A31 are supplied to intermediate chutes 307A1 and 307A2.

Similarly, after a filling material B31 supplied from a branch part 305BS1 is split into two lines and weighed in the weighing and supplying device 306, the filling materials B31 are supplied to intermediate chutes 307B1 and 307B2.

Further, similarly, after the filling material A31 supplied from a branch part 305AS2 is split into two lines and weighed in the weighing and supplying device 306, the filling materials A31 are supplied to intermediate chutes 307A3 and 307A4.

Further, after the filling material B31 supplied from a branch part 305BS2 is split into two lines and weighed in the weighing and supplying device 306, the filling materials B31 are supplied to intermediate chutes 307B3 and 307B4.

In this embodiment, when the number of individual packaging bags P36 on a product slide 311 reaches four, a gate of a measuring stopper 312 is opened. Thus, as illustrated in FIG. 6, four individual packaging bags P36 are put into one group (one set) of individual packaging bags P37, and are discharged from each of eight lines of the product slides 311 so as to be placed on an upper surface of a discharge conveyor 313.

Figure 8:
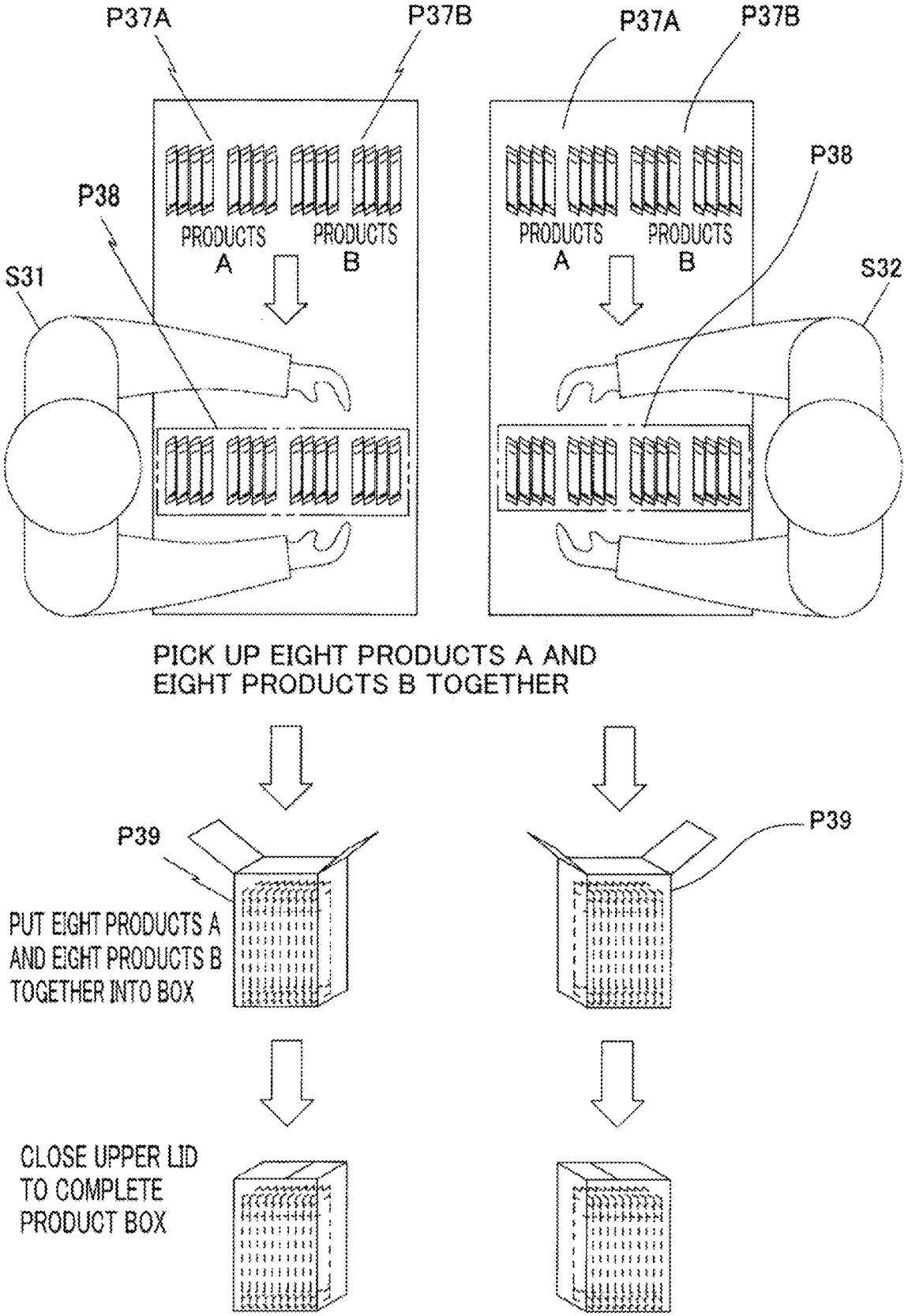
FIG. 8 is an explanatory view for illustrating one example of a boxing-up operation for making assortment packs, which is performed by workers, according to the second embodiment.
Figure 9:
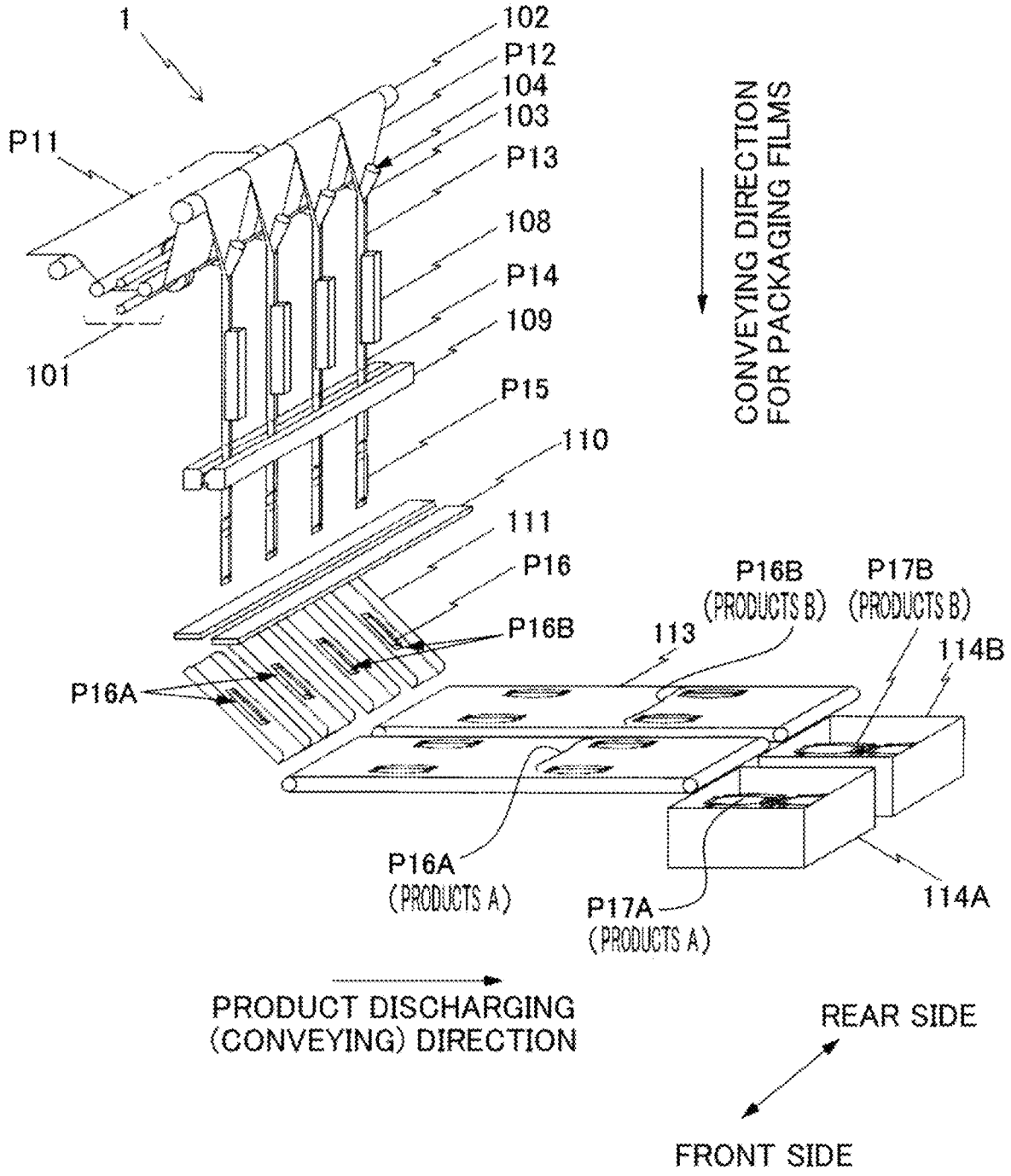
FIG. 9 is a perspective view for illustrating filling and packaging parts extracted from a related-art automatic filling and packaging machine.

Thus, in this embodiment, as illustrated in FIG. 8, a worker S31 takes out two sets of four products A (P37A) and two sets of four products B (P37B) to put the products together into one group (one set) and thus can take out the group as a product group P38 (eight products A (P37A) and eight products B (P37B)) without counting the number of individual packaging bags P36. After directly putting the thus taken-out product group P38 into a box without counting the number of individual packaging bags P36 contained in the product group P38, the worker closes a lid of the box to thereby complete a product box P39.

Further, similarly, a worker S32 facing the worker S31 also takes out two sets of four products A (P37A) and two sets of four products B (P37B) to put the products together into one group (one set) and thus can take out the group as the product group P38 without counting the number of individual packaging bags P36 in the product group P38. After directly putting the thus taken-out product group P38 into a box without counting the number of individual packaging bags P36 contained in the product group P38, the worker closes a lid of the box to thereby complete a product box P39.

Specifically, according to this embodiment, products can be discharged in a way that meets various requests. Hence, an operation that is more liable to cause an error, for example, a manual counting operation performed by a worker, can be eliminated, thus contributing to achievement of an assortment packing operation with fewer errors (human errors).

As described above, according to this embodiment, the multiline vertical automatic filling and packaging machine has the lines for supplying one kind of filling material and the lines for filling a different kind of filling material, which are arranged alternately. Thus, the multiline vertical automatic filling and packaging machine having a configuration at low cost, does not impair the workability at the time of supplying (feeding) the filling materials into the hoppers while maintaining the productivity for the packaging bags. Hence, the multiline vertical automatic filling and packaging machine that can contribute to achievement of a way of discharging (discharge layout of) products (packaging bags) in accordance with a request from a factory or the like and the hopper used for the multiline vertical automatic filling and packaging machine can be provided.

Further, only the hoppers 305 are required to replace the related-art hoppers 105 in the automatic filling and packaging machine including the hoppers 105 as illustrated in FIG. 10. Thus, such a configuration can increase a degree of freedom in the way of discharging products at low cost, and thus can contribute to providing the automatic filling and packaging machine that is easy to use.

Specifically, according to this embodiment, the multiline vertical automatic filling and packaging machine has multiple lines equal to or more than three lines including the lines for supplying one kind of filling material and the line for filling a different kind of filling material in which the line for filling a different kind of filling material can be arranged between the lines for supplying the one kind of filling material. Thus, the multiline vertical automatic filling and packaging machine having a configuration at low cost, which does not impair the workability at the time of supplying (feeding) the filling materials into the hoppers while maintaining the productivity for the packaging bags, and the hopper used for the multiline vertical automatic filling and packaging machine can be provided.

The hopper includes: an upwardly open (305A) receiving part 305AL having an upper opening with a relatively large transverse sectional area in a horizontal direction; and the first branch part (305AS1) and the second branch part (305AS2), which are bifurcated from a lower portion of the upwardly open receiving part 305AL and each have a smaller transverse sectional area in the horizontal direction than the transverse sectional area of the upwardly open receiving part. The first branch part (305AS1) and the second branch part (305AS2) allow the filling material A (A31) to be supplied to corresponding ones (3031, 3032, 3035, and 3036) of the plurality of lines of the filling pipes from outlets of the first branch part (305AS1) and the second branch part (305AS2), and the first branch part (305AS1) or the second branch part (305AS2) is extended in a direction of arrangement of the plurality of lines of the filling pipes so that at least one (3033, 3034) of the filling pipes for supplying the filling material B (B31) supplied from the hopper (305B) is located between the outlet of the first branch part (305AS1) and the outlet of the second branch part (305AS2) in the direction of arrangement of the plurality of lines of the filling pipes.

In each of the embodiments described above, as illustrated in FIG. 4 and FIG. 8, there has been described a case in which the worker manually puts the products into a box. However, boxing-up may also be performed using a simple mechanism of, for example, pushing out the product group (P28, P38) on the discharge conveyors 213 (313) illustrated in FIG. 4 in a lateral direction.

Further, each of the embodiments has been described based on an example in which the stick packaging bags (vertical pillow-shaped packaging bags) are continuously produced. However, the present invention is not limited to the example described above. The present invention is applicable to any automatic filling and packaging machines in which the hopper according to the present invention can be used.

Further, the packaging film according to the present invention is not limited to a particular one. For example, a base film made of, for example, PET, a heat seal film made of, for example, polyethylene having a lower melting point than that of the base film, or a packaging film having a three-layer structure of the base film, an intermediate film, and the heat seal film may be used.

Further, in the second embodiment, there has been exemplified a configuration in which eight stick packaging bags can be continuously sealed and formed at one time. However, the present invention is not limited to the configuration described above. The following configuration may also be used. For example, when the number of lines is desired to be increased in accordance with specifications of products to be put into a box, the filling materials are supplied through the first to fourth branch parts so that the filling material is supplied to three filling pipes through each of the branch parts. In this manner, twelve stick packaging bags are continuously sealed and formed at one time.

Further, in the second embodiment, there has been exemplified a configuration in which four stick packaging bags containing the filling material A and four stick packaging bags containing the filling material B can be continuously sealed and formed at one time. For example, when a ratio of the number of stick packaging bags containing the filling material A and the number of stick packaging bags containing the filling material B in the product box is desired to be changed from 1:1 to 1:2, the filling material is supplied to two filling pipes through each of the first branch part and the second branch part and the filling material is supplied to four filling pipes through each of the third branch part and the fourth branch part so that four sticks containing the filling material A and eight sticks containing the filling material B, that is, a total of twelve stick packaging bags are continuously sealed and formed at one time.

According to the present invention, the multiline vertical automatic filling and packaging machine has multiple lines equal to or more than three lines including the lines for supplying one kind of filling material and the line for filling a different kind of filling material, in which the line for filling a different kind of filling material can be arranged between the lines for supplying the one kind of filling material. Thus, the multiline vertical automatic filling and packaging machine having a configuration at low cost, which does not impair the workability at the time of supplying (feeding) the filling materials into the hoppers while maintaining the productivity for the packaging bags, and the hopper used for the multiline vertical automatic filling and packaging machine can be provided.

The embodiments described above are merely an example for describing the present invention, and various modifications may be made without departing from the gist of the present invention.

What is claimed is:

1. A multiline vertical automatic filling and packaging machine configured to produce packaging bags by winding a plurality of lines equal to or more than three lines of packaging films being continuously conveyed, around outer peripheries of filling pipes, which are provided so as to extend in a vertical direction and are arranged in a plurality of lines corresponding to the plurality of lines of the packaging films, each into a substantially cylindrical shape, performing vertical sealing on a right end and a left end of each of the packaging films, the right end and the left end extending in a longitudinal direction of the packaging film, to form a cylindrical packaging film, performing lateral sealing on each of the cylindrical packaging films at a predetermined position to form an upwardly open packaging bag, supplying a filling material into the upwardly open packaging bags via the filling pipes, and performing lateral sealing on each of the cylindrical packaging bags at a position higher than the predetermined position to achieve sealing, the multiline vertical automatic filling and packaging machine comprising:

a hopper A configured to store a filling material A and supply the filling material A to at least a corresponding one of the plurality of lines of the filling pipes; and a hopper B configured to store a filling material B and supply the filling material B to at least a corresponding one of the plurality of lines of the filling pipes, wherein the hopper A includes:

an upwardly open receiving part having an upper opening with a relatively large transverse sectional area taken in a horizontal direction; and a first branch part and a second branch part bifurcated from a lower portion of the upwardly open receiving part, the first branch part and the second branch part each having a smaller transverse sectional area in the horizontal direction than the transverse sectional area of the upwardly open receiving part in the horizontal direction, wherein the first branch part has an outlet and the second branch part has an outlet, and each of the outlets allows the filling material A to be supplied to at least a corresponding one of the plurality of lines of the filling pipes, and wherein one of the first branch part or the second branch part is extended in a direction of arrangement of the plurality of lines of the filling pipes so that at least one of the filling pipes that allows supply of the filling material B supplied from the hopper B is located between the outlet of the first branch part and the outlet of the second branch part in the direction of arrangement of the plurality of lines of the filling pipes.

2. The multiline vertical automatic filling and packaging machine according to claim 1, wherein the hopper B includes:

an upwardly open receiving part having an upper opening with a relatively large transverse sectional area in a horizontal direction; and a third branch part and a fourth branch part bifurcated from a lower portion of the upwardly open receiving part, the third branch part and the fourth branch part each having a smaller transverse sectional area in the horizontal direction than the transverse sectional area of the upwardly open receiving part in the horizontal direction, wherein the third branch part has an outlet and the fourth branch part has an outlet, and each of the outlets allows the filling material B to be supplied to at least a corresponding one of the plurality of lines of the filling pipes, wherein one of the third branch part or the fourth branch part is extended in the direction of arrangement of the plurality of lines of the filling pipe so that at least one of the filling pipes that allows supply of the filling material A supplied from the hopper A is located between the outlet of the third branch part and the outlet of the fourth branch part in the direction of arrangement of the plurality of lines of the filling pipes, and wherein the hopper A and the hopper B are arranged so that the branch parts, each being extended in the direction of arrangement of the plurality of lines of the filling pipes, face each other.

3. A hopper configured to store a filling material and supply the filling material to filling pipes, the hopper to be used for a multiline vertical automatic filling and packaging machine configured to produce packaging bags by winding a plurality of lines equal to or more than three lines of packaging films being continuously conveyed, around outer peripheries of filling pipes, which are provided so as to extend in a vertical direction and are arranged in a plurality of lines corresponding to the plurality of lines of the packaging films, each into a substantially cylindrical shape, performing vertical sealing on a right end and a left end of each of the packaging films, the right end and the left end extending in a longitudinal direction of the packaging film, to form a cylindrical packaging film, performing lateral sealing on each of the cylindrical packaging films at a predetermined position to form an upwardly open packaging bag, supplying a filling material into the upwardly open packaging bags via the filling pipes, and performing lateral sealing on each of the cylindrical packaging bags at a position higher than the predetermined position to achieve sealing, the hopper comprising:

an upwardly open receiving part having an upper opening with a relatively large transverse sectional area in a horizontal direction; and a first branch part and a second branch part bifurcated from a lower portion of the upwardly open receiving part, the first branch part and the second branch part each having a smaller transverse sectional area in the horizontal direction than the transverse sectional area of the upwardly open receiving part in the horizontal direction, wherein the first branch part has an outlet and the second branch part has an outlet, and each of the outlets allows the filling material to be supplied to at least a corresponding one of the plurality of lines of the filling pipes, and wherein one of the first branch part or the second branch part is extended in a direction of arrangement of the plurality of lines of the filling pipes so that at least one of the filling pipes that allows supply of a filling material supplied from another hopper is located between the outlet of the first branch part and the outlet of the second branch part in the direction of arrangement of the plurality of lines of the filling pipes.

4. A hopper configured to store a filling material and supply the filling material to filling pipes, the hopper to be used for a multiline vertical automatic filling and packaging machine configured to produce packaging bags by winding a plurality of lines equal to or more than three lines of packaging films being continuously conveyed, around outer peripheries of filling pipes, which are provided so as to extend in a vertical direction and are arranged in a plurality of lines corresponding to the plurality of lines of the packaging films, each into a substantially cylindrical shape, performing vertical sealing on a right end and a left end of each of the packaging films, the right end and the left end extending in a longitudinal direction of the packaging film, to form a cylindrical packaging film, performing lateral sealing on each of the cylindrical packaging films at a predetermined position to form an upwardly open packaging bag, supplying a filling material into the upwardly open packaging bags via the filling pipes, and performing lateral sealing on each of the cylindrical packaging bags at a position higher than the predetermined position to achieve sealing, the hopper comprising:

an upwardly open receiving part having an upper opening with a relatively large transverse sectional area in a horizontal direction; and a first branch part and a second branch part bifurcated from a lower portion of the upwardly open receiving part, the first branch part and the second branch part each having a smaller transverse sectional area in the horizontal direction than the transverse sectional area of the upwardly open receiving part in the horizontal direction, wherein the first branch part has an outlet and the second branch part has an outlet, and each of the outlets allows the filling material to be supplied to at least a corresponding one of the plurality of lines of the filling pipes, wherein one of the first branch part or the second branch part is extended in a direction of arrangement of the plurality of lines of the filling pipes so that at least one of the filling pipes that allows supply of a filling material supplied from another hopper is located between the outlet of the first branch part and the outlet of the second branch part in the direction of arrangement of the plurality of lines of the filling pipes, and wherein, independently of the hopper, a hopper having the same configuration as that of the hopper is arranged so that branch parts on a side of extending in the direction of the arrangement of the plurality of lines of the filling pipes face each other.

* * * * *